US009316077B2

(12) United States Patent
Clemens et al.

(10) Patent No.: US 9,316,077 B2
(45) Date of Patent: Apr. 19, 2016

(54) HYDROSTATIC PRESSURE ACTUATED STROKE AMPLIFIER FOR DOWNHOLE FORCE GENERATOR

(75) Inventors: Jack Gammill Clemens, Fairview, TX (US); David Russ Larimore, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 413 days.

(21) Appl. No.: 13/885,355

(22) PCT Filed: Aug. 20, 2012

(86) PCT No.: PCT/US2012/051545

§ 371 (c)(1),
(2), (4) Date: May 14, 2013

(87) PCT Pub. No.: WO2014/031092

PCT Pub. Date: Feb. 27, 2014

(65) Prior Publication Data

US 2014/0048288 A1 Feb. 20, 2014

(51) Int. Cl.
*E21B 23/04* (2006.01)
*E21B 23/08* (2006.01)

(52) U.S. Cl.
CPC ..... *E21B 23/08* (2013.01); *E21B 23/04* (2013.01)

(58) Field of Classification Search
CPC ..... E21B 23/00; E21B 23/04; E21B 23/08
See application file for complete search history.

(56) References Cited

U.S. PATENT DOCUMENTS

| | | | |
|---|---|---|---|
| 3,524,503 | A | 8/1970 | Baker |
| 3,891,034 | A | 6/1975 | Owen et al. |
| 4,962,815 | A | 10/1990 | Schultz |
| 6,666,275 | B2 | 12/2003 | Neal |
| 7,000,705 | B2 | 2/2006 | Buyers et al. |
| 7,051,810 | B2 | 5/2006 | Clemens |
| 7,367,397 | B2 | 5/2008 | Clemens |
| 7,467,661 | B2 | 12/2008 | Gordon |

(Continued)

FOREIGN PATENT DOCUMENTS

| | | |
|---|---|---|
| EP | 0477452 | 4/1992 |
| WO | 97-09510 | 3/1997 |
| WO | 2008128543 | 10/2008 |

OTHER PUBLICATIONS

Written Opinion dated Mar. 21, 2013 for Application No. PCT/US2012/051545.

(Continued)

*Primary Examiner* — Brad Harcourt
(74) *Attorney, Agent, or Firm* — Chamberlain Hrdlicka

(57) ABSTRACT

Methods and apparatus are presented for a hybrid downhole force generator (DFG) using a stroke amplifier driven by hydrostatic pressure for a low-force, long-stroke portion of setting a downhole tool and a DFG powered shaft for a high-force, short-stroke portion of setting the tool. The stroke amplifier has a piston slidable in a housing, movable in response to hydrostatic pressure. The DFG powered shaft is connected to the piston via one-way slips which allow relative motion of the piston and shaft in one direction. The amplifier housing is connected to the DFG housing. In use, the DFG shaft is powered by a power supply, such as an electric motor, etc. The shaft is powered to shear a shearing mechanism, freeing the piston to move in response to the hydrostatic pressure.

27 Claims, 5 Drawing Sheets

(56) References Cited

U.S. PATENT DOCUMENTS

| | | | | |
|---|---|---|---|---|
| 7,891,432 | B2 | 2/2011 | Assal | |
| 2009/0223675 | A1 * | 9/2009 | Li et al. | 166/375 |
| 2010/0258293 | A1 * | 10/2010 | Lynde et al. | 166/66 |
| 2011/0073310 | A1 | 3/2011 | Clemens | |
| 2011/0073328 | A1 | 3/2011 | Clemens | |
| 2011/0073329 | A1 | 3/2011 | Clemens | |
| 2011/0168403 | A1 | 7/2011 | Patel | |

OTHER PUBLICATIONS

International Search Report dated Mar. 21, 2013 for Application No. PCT/US2012/051545.

* cited by examiner

HYDROSTATIC PRESSURE ACTUATED STROKE AMPLIFIER FOR DOWNHOLE FORCE GENERATOR

CROSS-REFERENCE TO RELATED APPLICATIONS

None.

FIELD OF INVENTION

Methods and apparatus are presented for a hybrid downhole force generator (DFG) using a combination of hydrostatic pressure and electro-mechanical power to set wellbore sealing devices. More specifically, a stroke amplifier powered by hydrostatic pressure is presented for use in conjunction with a DFG for providing a relatively longer stroke than is typically available on DFG units.

BACKGROUND OF INVENTION

It is typical in hydrocarbon wells to "set" or actuate a downhole tool, such as packers, bridge plugs, high-expansion gauge hangers, straddles, wellhead plugs, cement retainers, through-tubing plugs, etc. Some of these downhole tools are set to selectively seal a fluid pathway, such as a wellbore annulus defined between the wellbore and tubing string or the primary through-bore of the string. These tools are run-in and in some cases retrieved using various conveyance methods such as a wireline, slickline, or coiled tubing. The DFG unit is often retrieved after setting the downhole tool. The DFG unit used for setting tools can be mechanically, electrically, chemically, explosively, hydraulically, electro-mechanically or otherwise powered. One type of DFG uses electro-mechanical power, where the DFG converts electrical power, typically provided by a battery unit, into mechanical movement, typically rotary or longitudinal movement of a shaft or power rod. One such setting tool is the DPU (trade name) Downhole Power Unit available from Halliburton Energy Services, Inc. Disclosure relating to DFG units, their operation and construction can be found in the following, which are each incorporated herein for all purposes: U.S. Pat. No. 7,051,810 to Clemens, filed Sep. 15, 2003; U.S. Pat. No. 7,367,397 to Clemens, filed Jan. 5, 2006; U.S. Pat. No. 7,467,661 to Gordon, filed Jun. 1, 2006; U.S. Pat. No. 7,000,705 to Baker, filed Sep. 3, 2003; U.S. Pat. No. 7,891,432 to Assal, filed Feb. 26, 2008; U.S. Patent Application Publication No. 2011/0168403 to Patel, filed Jan. 7, 2011; U.S. Patent Application Publication Nos. 2011/0073328 to Clemens, filed Sep. 23, 2010; 2011/0073329 to Clemens, filed Sep. 23, 2010; 2011/0073310 to Clemens, filed Sep. 23, 2010.

Electro-mechanical DFG setting tools are commonly available and can be purchased in various sizes, including various stroke lengths. While most downhole tools require a relatively short stroke to set, other downhole tools require a longer stroke than is typically available from an electro-mechanical DFG. Additionally, electro-mechanical DFG setting tools tend to have a relatively slower setting speed, resulting in longer setting times. Consequently, there is a need for methods and apparatus for improved electro-mechanical downhole force generators having a relatively longer setting stroke and a relatively quicker setting speed for use with downhole tools.

SUMMARY OF THE INVENTION

Methods and apparatus for treating a subterranean well are presented. Methods and apparatus are presented for a hybrid downhole force generator (DFG) using a combination of hydrostatic pressure and electro-mechanical power to set wellbore sealing devices. More specifically, a stroke amplifier powered by hydrostatic pressure is presented for use in conjunction with a DFG for providing a relatively longer stroke than is typically available on DFG units.

In a preferred embodiment, a stroke amplifier apparatus is presented having a piston slidable within a housing and movable in response to hydrostatic pressure. The stroke amplifier provides for a relatively longer, low-force stroke of the downhole tool. For example, the piston stroke may be over 50 inches long and at a force of 2000 pounds, the force supplied by the hydrostatic pressure. The stroke of the amplifier assembly can partially set the downhole tool, for example setting the anti-extrusion rings, upper and lower slips, etc. The DFG, with its shorter, higher force stroke, would set the downhole tool for the higher force events, like the compression of the tool elements and shear release. For example, the powered shaft can provide force up to 12,000 pounds but perhaps at only a six to nine inch stroke length and at a slower stroke rate. The DFG powered shaft is connected to the piston via one-way slips which allow relative motion of the piston and shaft in one direction. The amplifier assembly housing is preferably directly connected to the DFG housing. In use, the DFG shaft is powered by a power supply, such as an electric motor, explosive or chemical reaction, etc. The shaft is powered to shear a shearing mechanism, freeing the piston to move in response to the hydrostatic pressure.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a vertical wellbore; however, the inventions disclosed herein can be used in horizontal, vertical or deviated wellbores.

Figure 1:
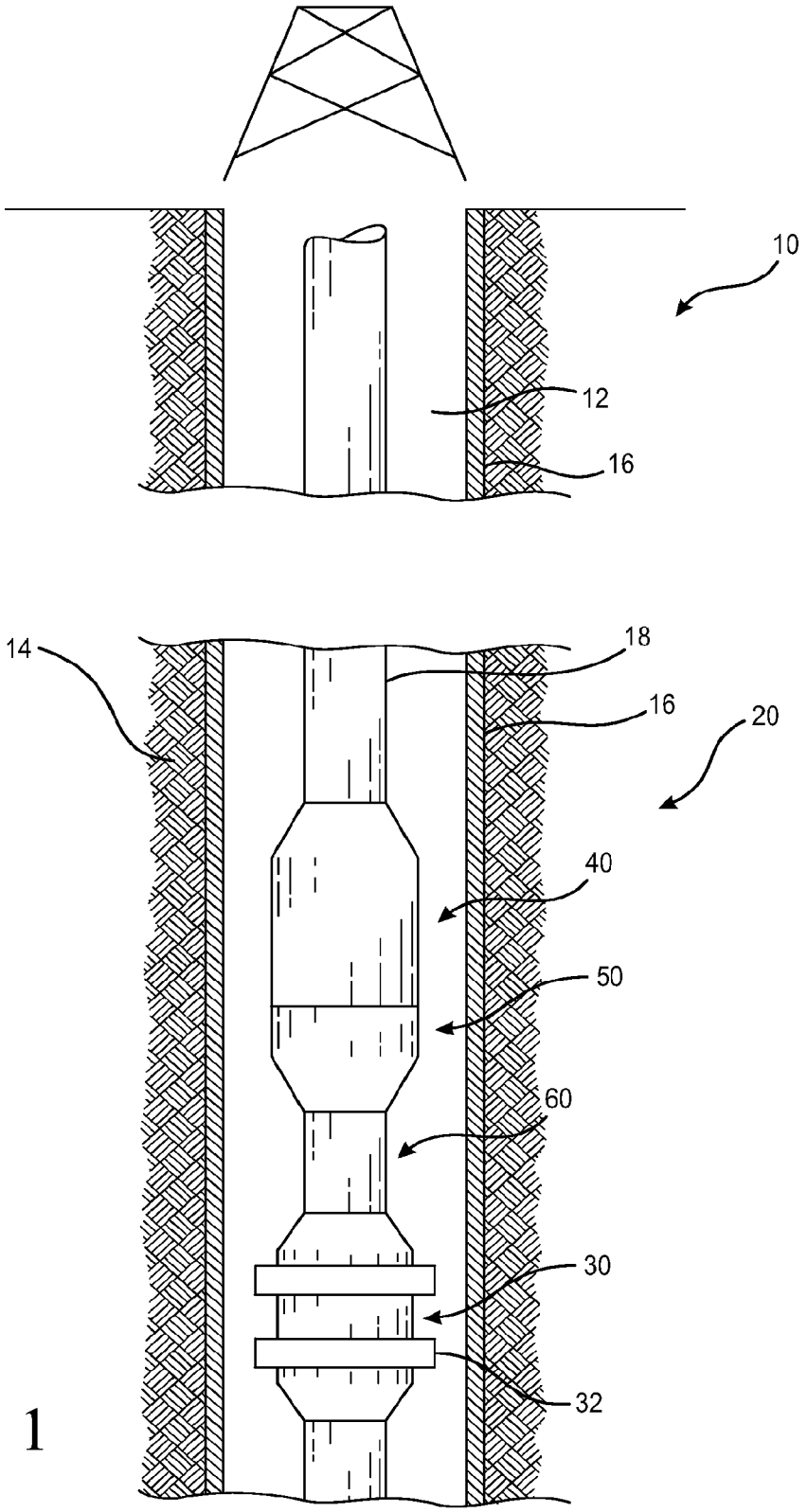
FIG. 1 is a schematic view of a well system including an embodiment of the invention positioned in a subterranean wellbore.

FIG. 1 is a schematic view of a well system including an embodiment of the invention positioned in a subterranean wellbore. A well system 10 is depicted having a wellbore 12 extending through a subterranean formation 14, shown having casing 16. The invention can be used in cased or uncased wells, vertical, deviated or horizontal wells, and for on-shore or off-shore drilling. A tubing string 18 is shown having tubing sections 20, a downhole tool 30, a DFG 40, and a stroke amplifier assembly 50. A mechanical linkage assembly 60 between the DFG and the downhole tool is provided for transferring the power generated by the DFG into longitudinal or rotary movement, such via a shaft, piston, sleeve, etc. The DFG includes a processor to operate the DFG, measure environmental and tool parameters, etc. See the incorporated references for additional disclosure of electro-mechanical DFG methods and apparatus. The downhole tools compatible with DFG units will not be described in detail and are known in the art. For ease of discussion, and by way of example, downhole tools include settable downhole tools such as settable tool 30, shown as a packer, which may be utilized in sealing and anchoring the tubing string at a downhole location. The packer has sealing elements 32 which may be set by DFG 40 via linkage assembly 60.

A stroke amplifier assembly 50 is powered by hydrostatic pressure and assists the DFG 40 in setting the tool and will be discussed further herein. The invention described herein is a stroke amplifier for use in conjunction with downhole DFG units. The discussion and figures will primarily refer to electro-mechanical DFG units for ease of discussion and as an exemplary use of the apparatus and methods, however, the invention can be used on electro-mechanical DFG units powered chemically, explosively, etc. The stroke amplifier assembly effectively creates a hybrid downhole force generator that uses a combination of hydrostatic pressure to drive the amplifier and electro-mechanical (or other) power to drive the mechanical linkage. Such a stroke amplifier is particularly useful for settable tools requiring a setting stroke greater than typically available using a standard-stroke electro-mechanical DFG. The tool will permit setting wellbore sealing devices with setting tools currently deployed throughout the world at a higher setting speed than currently available in electric powered setting tools. Current DFG units typically have a stroke of approximately nine inches. A nine inch stroke is more than adequate to fully set many downhole settable devices, but some require a much greater stroke.

Figure 2:
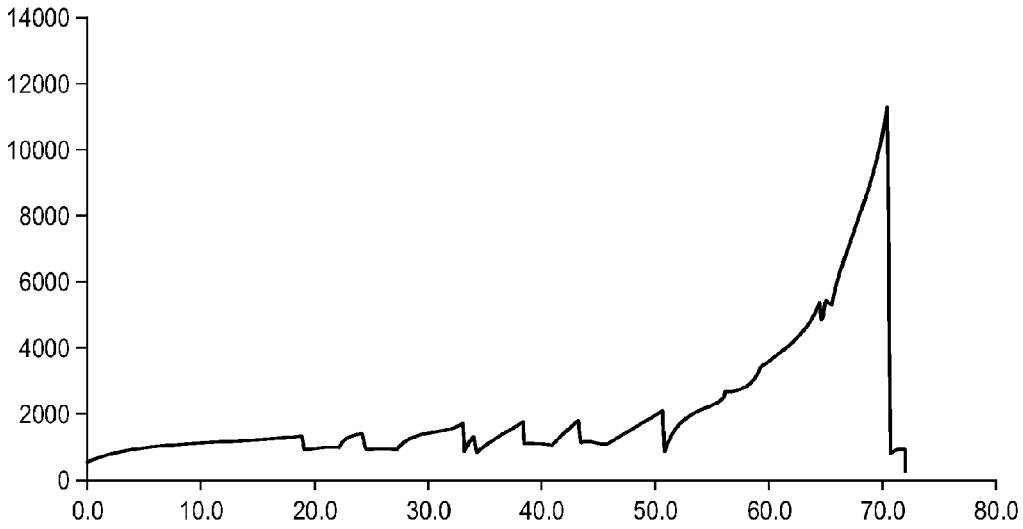
FIG. 2 is a graphical representation of a power curve showing setting force (in pounds) versus stroke distance (in inches) for a typical setting event utilizing a stroke amplifier assembly in conjunction with a DFG unit.

FIG. 2 is a graphical representation of a power curve showing setting force (in pounds) versus stroke distance (in inches) for a typical setting event utilizing a stroke amplifier assembly in conjunction with a DFG unit. The stroke amplifier and DFG unit allowed a total stroke length of approximately 70 inches. A typical setting event does not require peak setting force until the last few inches of the stroke of the setting event. FIG. 2 is a power curve recorded while setting a through-tubing bridge plug (TTBP). The shear release of the plug occurs at approximately 11,200 pounds. As the curve indicates, the setting force for this event did not exceed 2,000 pounds until approximately 55 inches of stroke. The various smaller peaks between about eighteen and 50 inches of stroke indicate setting forces for anti-extrusion rings, upper and lower slips, etc., of the settable tool. Thus, the total stroke length can be divided into an earlier, low-force, long-stroke portion and a later, high-force, short-stroke portion associated with shear release of the settable tool. The low-force, long-stroke portion of the stroke is activated using hydrostatic pressure on the relatively lengthy stroke amplifier, with short-stroke portion (the final few inches of the total stroke) of higher-force shear is conducted with the electrically powered DFG.

Figure 3:
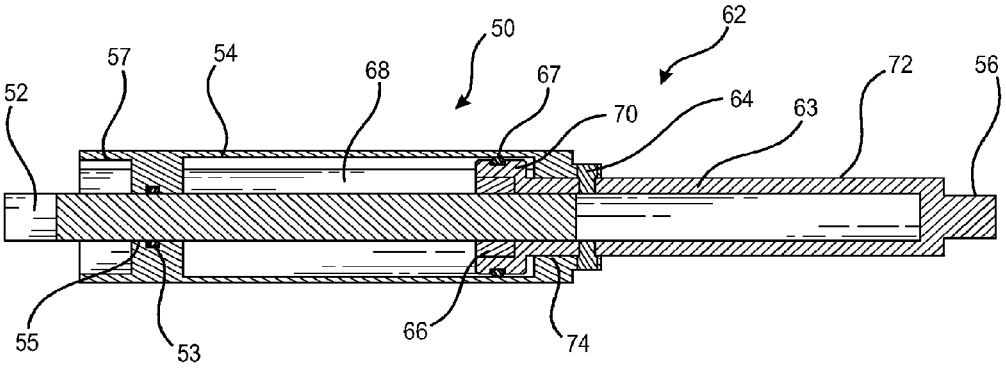
FIG. 3 is a schematic view of an exemplary embodiment of a stroke amplifier assembly according to an aspect of the invention.

FIG. 3 is a schematic view of an exemplary embodiment of a stroke amplifier assembly according to an aspect of the invention. The stroke amplifier assembly 50 attaches to a DFG unit. In a preferred embodiment, the amplifier assembly attaches to an electrically powered DFG unit as is disclosed and discussed herein. The stroke amplifier assembly 50 includes a follower rod 52 connectable to a powered shaft of a DFG, a housing 54 attachable to a DFG housing, and a slidable piston assembly 62 having a piston 63 attachable to a settable tool at its lover end. Reference is made to the exemplary DFG unit in FIGS. 7-9, described below, which can be modified as explained herein and otherwise.

Figure 7:
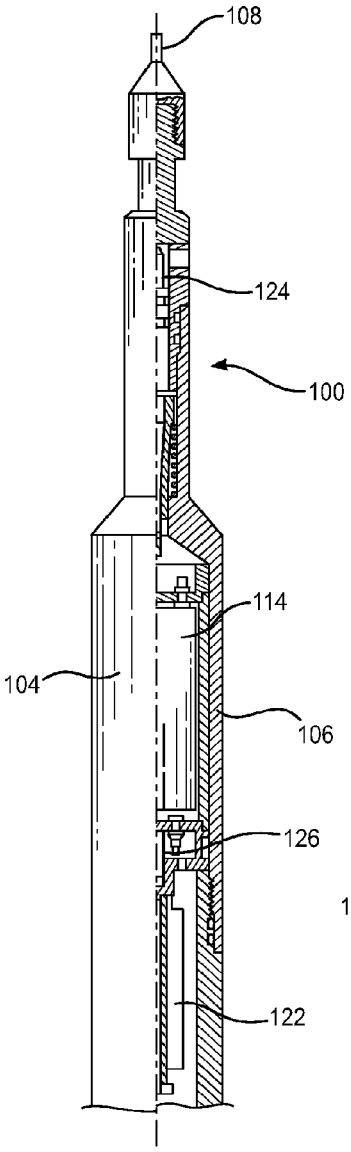
FIGS. 7-9 are quarter sectional view of a portion of an embodiment of a downhole force generator for use in conjunction with the present invention.
Figure 8:
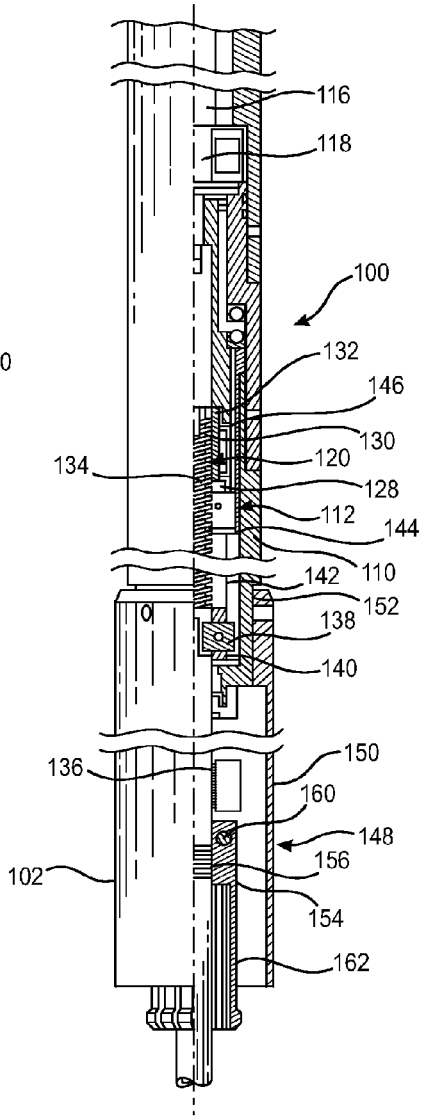
Figure 9:
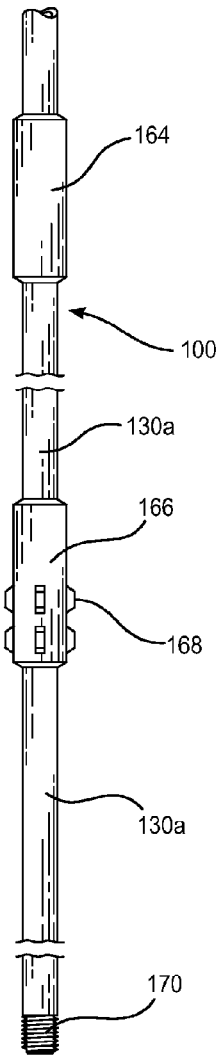

The follower rod 52 connects to the powered rod or shaft 130 of the DFG unit. Consequently or alternately, the powered shaft 130 is connected to the piston 63 via one-way slips 66. The follower rod extends from the amplifier housing 54 through a follower rod borehole 55. Seals 53 preferably seal against excessive fluid leaking between the rod and housing. The powered shaft can be driven longitudinally, rotationally, or both, depending on the DFG design. The amplifier housing 54 connects to the DFG housing 110 via threaded connection 57 at coupling 152 to the DFG assembly. Alternately, the amplifier can be otherwise connected to the DFG unit. In a preferred embodiment, the sleeve assembly 150 and connector subassembly 154 and their associated parts, seen in FIGS. 7-9, are not present. On the lower end of the stroke amplifier assembly, the threaded connections 56 are configured to simulate a normal long-stroke setting tool for attaching to a settable tool. A movable piston assembly 62 is movably retained in the amplifier housing 54. For example, the piston 63 in its run-in position has a piston head 70 located within a cylinder chamber 68 defined by the housing 54. The cylinder chamber is preferably filled with fluid, preferably air. Seals 67 are preferably positioned on the piston head and in contact with the powered shaft. The body 72 of the piston initially extends from the housing through a housing borehole 74. The piston is pinned with shear devices 64 (here, pins) to the housing 54. Appropriate seals may be employed. The shear pins prevent premature setting that might otherwise occur prematurely due to hydrostatic pressure in the wellbore.

The stroke length of the amplifier assembly is preferably 55-60 inches long, although the length may vary depending on design. The stroke length of the DFG powered shaft 130, by comparison, is typically around 9 inches long or shorter. Consequently, the stroke amplifier provides significant additional stroke length. Further, the hydrostatically driven piston strokes at a relatively high stroke speed, whereas the electrically driven powered shaft strokes at a much slower speed. Since the amplifier strokes a relatively long distance in a short period, the amplifier assembly provides the power to stroke the settable tool during the low-force portion of the stroke. The high-power portion of the stroke is handled by the electrically driven DFG powered shaft.

Figure 4:
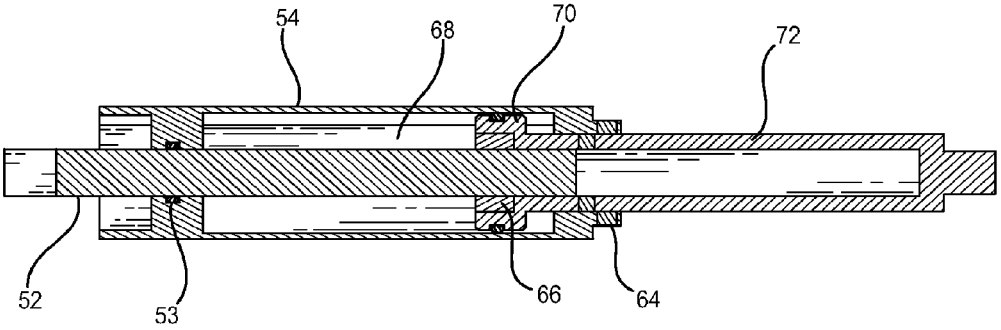
FIG. 4 is a schematic view of a stroke amplifier according to FIG. 3 in a preliminary set position with shear devices sheared.

FIG. 4 is a schematic view of a stroke amplifier according to FIG. 3 in a preliminary set position with shear devices sheared. Once the stroke amplifier assembly reaches the target zone, the DFG logic will activate the initial setting event. The DFG logic and its control of the DFG assembly is disclosed in the incorporated references. The DFG operates to actuate powered shaft 130, thereby moving the connected follower rod 52 inwardly towards the DFG body (upwardly in FIGS. 7-9; left in FIGS. 3-6). The shear devices 64 are sheared by the DFG power shaft stroking inward. Preferably, "one-way slips" 66 attach the follower rod 52 to the piston 63. The "one-way slips" 66 pull the large piston inward as the powered shaft strokes inward but allow relative movement between the follower shaft 52 and piston 63 when the powered shaft moves outward. The slips are preferably attached to the piston by threaded connection but can also be welded, pinned, keyed, etc.

Figure 5:
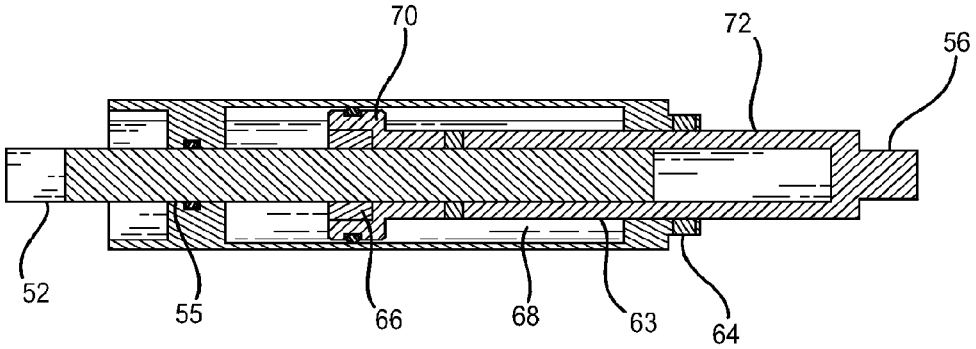
FIG. 5 is a schematic view of a stroke amplifier according to FIG. 3 in an intermediate position during hydrostatic setting of the amplifier.

FIG. 5 is a schematic view of a stroke amplifier according to FIG. 3 in an intermediate position during hydrostatic setting of the amplifier. After the shear devices are sheared, the piston 63 is free to move with respect to the housing 54. The one-way slips 66 allow relative movement of the piston inwardly with respect to the follower rod 52. Hydrostatic pressure from fluid present in the wellbore drives the piston 63 inwardly, towards the DFG unit. While the stroke amplifier is stroking (the piston moving longitudinally and actuating the attached settable tool), the DFG unit preferably continues to operate. Operation of the DFG unit moves powered shaft 130 inwardly at a slower stroke speed relative to the hydrostatic setting speed of the piston. The hydrostatic stroking event speed can be selectively limited by a fluid by-pass 76 in the assembly. Motion of the piston is stopped when the force required for the high-force setting events exceeded the force provided by the hydrostatic piston.

Figure 6:
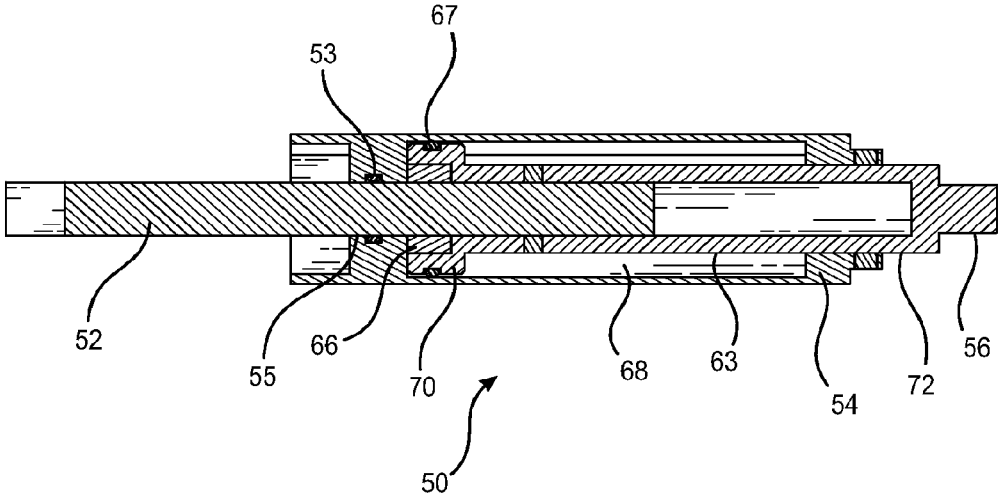
FIG. 6 is a schematic view of a stroke amplifier according to FIG. 3 in a fully stroked or final position.

FIG. 6 is a schematic view of a stroke amplifier according to FIG. 3 in a fully stroked or final position. In the final step, the electrically powered shaft 130 of the DFG unit strokes the final, short distance moving the follower rod 52, and via the one-way slips 66, the piston 63 and thereby completing the setting of the settable tool. The final portion of the stroke is typically at a significantly higher power to shear release the settable tool.

Existing tools have used all hydrostatic setting power or all electrical power. The battery powered stroke amplifier permits running the long stroke wellbore sealing tool on a slickline. This tool will have very small electrical demand, which may be especially helpful where the DFG is battery powered. The hydrostatic setting event requires less force over a long distance and can be conducted at a higher activation speed. This enables the setting process to be completed in less time than with a purely electrically powered setting tool. Using a slickline conveyed setting tool with the stroke enhancement to set well bore sealing devices that have been normally set only on e-line or coil tubing provides value to the operator as the slickline is a less costly service, has a smaller well site footprint, and can be run in hole faster than other services.

Referring next to FIGS. 7-9, therein is depicted successive axial sections of an exemplary downhole force generator unit generally designated 100. Downhole force generator 100 includes a working assembly 102 and a power assembly 104. Power assembly 104 includes a housing assembly 106 which comprises suitably shaped and connected generally tubular housing members. An upper portion of housing assembly 106 includes an appropriate mechanism to facilitate coupling of housing 106 to a conveyance 108. Housing assembly 106 also includes a clutch housing 110 as will be described in more detail below, which forms a portion of a clutch assembly 112.

In the illustrated embodiment, power assembly 104 includes a self-contained power source, eliminating the need for power to be supplied from an exterior source, such as a source at the surface. A preferred power source comprises a battery assembly 114 which may include a pack of twenty to sixty alkaline or lithium batteries.

Connected with power assembly 104 is the force generating and transmitting assembly. The force generating and transmitting assembly of this implementation includes a direct current electric motor 116, coupled through a gearbox 118, to a jackscrew assembly 120. A plurality of activation mechanisms 122, 124 and 126, as will be described, can be electrically coupled between battery assembly 114 and electric motor 116. Gearbox 118 is coupled through a conventional drive assembly 128 to jackscrew assembly 120.

The ballscrew assembly 120 includes a threaded powered shaft 130 which moves longitudinally, rotates or both, in response to rotation of a sleeve assembly 132. Threaded shaft 130 includes a threaded portion 134, and a generally smooth, polished lower extension 136. Threaded powered shaft 130 further includes a pair of generally diametrically opposed keys 138 that cooperate with a clutch block 140 which is coupled to threaded shaft 130.

Clutch housing 110 includes a pair of diametrically opposed keyways 142 which extend along at least a portion of the possible length of travel. Keys 138 extend radially outwardly from threaded shaft 130 through clutch block 140 to engage each of keyways 142 in clutch housing 110, thereby selectively preventing rotation of threaded shaft 130 relative to housing 110.

Rotation of sleeve assembly 132 in one direction causes threaded shaft 130 and clutch block 140 to move longitudinally upwardly relative to housing assembly 110 if shaft 130 is not at its uppermost limit. Rotation of the sleeve assembly 132 in the opposite direction moves shaft 130 downwardly relative to housing 110 if shaft 130 is not at its lowermost position. Above a certain level within clutch housing 110, as indicated generally at 144, clutch housing 110 includes a relatively enlarged internal diameter bore 146 such that moving clutch block 140 above level 144 removes the outwardly extending key 138 from being restricted from rotational movement. Accordingly, continuing rotation of sleeve assembly 132 causes longitudinal movement of threaded shaft 130 until clutch block 140 rises above level 144, at which point rotation of sleeve assembly 132 will result in free rotation of threaded shaft 130. By virtue of this, clutch assembly 112 serves as a safety device to prevent burn-out of the electric motor, and also serves as a stroke limiter. In a similar manner, clutch assembly 112 may allow threaded shaft 130 to rotation freely during certain points in the longitudinal travel of threaded shaft 130.

In the illustrated embodiment, downhole force generator 100 incorporates three discrete activation assemblies, separate from or part of the microcontroller discussed above. The activation assemblies enable ballscrew 120 to operate upon the occurrence of one or more predetermined conditions. One depicted activation assembly is timing circuitry 122 of a type known in the art. Timing circuitry 122 is adapted to provide a signal to the microcontroller after passage of a predetermined amount of time. Further, downhole force generator 100 can include an activation assembly including a pressure-sensitive switch 124 of a type generally known in the art which will provide a control signal once the switch 124 reaches a depth at which it encounters a predetermined amount of hydrostatic pressure within the tubing string. Still further, downhole force generator 100 can include a motion sensor 126, such as an accelerometer or a geophone that is sensitive to motion of downhole force generator 100. Accelerometer 126 can be combined with timing circuitry 122 such that when motion is detected by accelerometer 126, timing circuitry 122 is reset. If so configured, the activation assembly operates to provide a control signal after accelerometer 126 detects that downhole force generator 100 has remained substantially motionless within the well for a predetermined amount of time.

Working assembly 102 includes an actuation assembly 148 which is coupled through housing assembly 106 to be movable therewith. Actuation assembly 148 includes an outer sleeve member 150 which is threadably coupled at 152 to housing assembly 106. Working assembly 102 also includes a connecting sub 154 which is releasably coupled at threaded connection 156 to a portion of polished extension 136 of threaded shaft 130 which allows for the disconnection of threaded shaft 130 from connecting sub 154 upon application of a predetermined axial force. Connecting sub 154 facilitates connecting downhole force generator 100 to an anchor or other tool. Specifically, connecting sub 154 is coupled through pins 160 and collet member 162.

The elements of the DFG unit illustrated in FIG. 6 can be employed between the stroke amplifier assembly and the settable tool as part of mechanical linkage assembly 60, for example. Alternately, the connector sub 154 and shaft 130*a* are connected to the lower end of the stroke amplifier assembly. In an exemplary embodiment, the shaft 130*a* is attached to the lower end 56 of the piston 62. The shaft 130*a* (in this design a follower shaft) includes a radially enlarged region 164 that interacts with collet member 162 when it is desired to release the anchor from the well as will be described below. Shaft 130*a* may also include a radially enlarged region 166 having locating keys 168 that interact with an anchor. The lower end 170 of threaded shaft 130 has a threaded coupling that allows for the coupling of downhole force generator 100 to an operating tool such as a pulling tool as will be described below or a shifting tool.

Exemplary methods of use of the invention are described, with the understanding that the invention is determined and limited only by the claims. Those of skill in the art will recognize additional steps, different order of steps, and that not all steps need be performed to practice the inventive methods described.

In preferred embodiments, the following methods are disclosed. A method for transmitting force to and setting a tool positioned in a wellbore, the method comprising the steps of: moving a piston a piston stroke length in response to hydrostatic pressure in the wellbore, thereby transmitting a first force to the settable tool by movement of the piston; partially setting the settable tool in response to the first force; moving a powered shaft a shaft stroke length using a downhole force generator including a power supply, thereby transmitting a second force to the settable tool by movement of the shaft; and partially setting the tool in response to the second force. Additional steps and combinations of steps are as follows: further comprising the step of moving the piston and moving the shaft in the same direction; further comprising the step of moving the piston and shaft at different speeds; further comprising the step of permitting relative movement between the shaft and piston in only a first direction; further comprising the step of moving the piston in response to moving the shaft; wherein the step of moving the shaft includes moving the shaft rotationally and longitudinally; further comprising regulating relative movement of the shaft and piston with a one-way slip assembly operably connected to the shaft and piston; wherein the step of moving the powered shaft further comprises the step of operating an electric motor to move the shaft; wherein the piston is operably connected to the settable tool and the powered shaft; wherein the first force is less than the second force; wherein the first force is operable to cause one or more setting events in the settable tool; wherein the second force is operable to cause the final setting event in the settable tool; wherein the final setting event includes shear release of the tool; further comprising the step of moving the piston the piston stroke length while the powered shaft is simultaneously moving; further comprising the step of moving the piston at least a portion of the shaft stroke length in response to movement of the shaft; further comprising the step of releasing the piston for movement in response to movement of the shaft; wherein the piston stroke length is longer than the shaft stroke length.

Disclosure relating to packers, through-tubing bridge plugs, and settable downhole tools can be found in the following which are hereby incorporated herein in their entirety for all purposes: U.S. Pat. No. 3,891,034 to Streich, filed Jan. 8, 1974; U.S. Pat. No. 6,666,275 to Neal, filed Aug. 2, 2001; U.S. Pat. No. 4,962,815 to Schultz, filed Jul. 17, 1989; U.S. Pat. No. 3,524,503 to Baker, filed Sep. 5, 1968.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

The invention claimed is:

1. A method for transmitting force to and setting a downhole tool positioned in a wellbore, the method comprising:

moving a piston a piston stroke length in response to hydrostatic pressure in the wellbore, thereby transmitting a first force to the downhole tool by movement of the piston;

partially setting the downhole tool in response to the first force;

moving a powered shaft a shaft stroke length using a downhole force generator including a power supply, thereby transmitting a second force to the downhole tool by movement of the shaft;

moving the piston the piston stroke length while simultaneously moving the powered shaft; and partially setting the tool in response to the second force.

2. A method as in claim 1, further comprising moving the piston and moving the shaft in the same direction.

3. A method as in claim 2, further comprising moving the piston and shaft at different speeds.

4. A method as in claim 3, further comprising permitting relative movement between the shaft and piston in only a first direction.

5. A method as in claim 4, further comprising moving the piston in response to moving the shaft.

6. A method as in claim 4, further comprising regulating relative movement of the shaft and piston with a one-way slip assembly operably connected to the shaft and piston.

7. A method as in claim 1, wherein moving the shaft includes moving the shaft rotationally and longitudinally.

8. A method as in claim 1, wherein moving the powered shaft further comprises the step of operating an electric motor to move the shaft.

9. A method as in claim 1, wherein the piston is operably connected to the downhole tool and the powered shaft.

10. A method as in claim 1, wherein the first force is less than the second force.

11. A method as in claim 10, wherein the first force is operable to cause one or more setting events in the downhole tool.

12. A method as in claim 11, wherein the second force is operable to cause the final setting event in the downhole tool.

13. A method as in claim 12, wherein the final setting event includes shear release of the tool.

14. A method as in claim 1, further comprising moving the piston at least a portion of the shaft stroke length in response to movement of the shaft.

15. A method as in claim 1, further comprising releasing the piston for movement in response to movement of the shaft.

16. A method as in claim 1, wherein the piston stroke length is longer than the shaft stroke length.

17. A setting assembly for applying force to a downhole tool positioned in a wellbore, the setting assembly comprising:

a downhole force generator having a moveable shaft, a power supply for moving the shaft a shaft stroke length;

a stroke amplifier assembly having a piston slidably retained in a housing, the piston responsive to hydrostatic pressure to move a piston stroke length, the piston releasably coupled to the moveable shaft to allow relative motion between the shaft and the piston in a first direction; and the piston operably engageable with the downhole tool such that movement of the piston in a first direction along the piston stroke length in response to hydrostatic pressure partially sets the downhole tool, and such that movement of the moveable shaft in the same direction along the shaft stroke length partially sets the downhole tool.

18. The setting assembly as in claim 17, wherein the power supply further comprises a self-contained power source for providing electrical power.

19. The setting assembly as in claim 17, wherein the moveable shaft is longitudinally moveable to generate a first longitudinal force on the downhole tool.

20. The setting assembly as in claim 19, wherein the piston is longitudinally movable to generate a second longitudinal force on the downhole tool.

21. The setting assembly as in claim 20, wherein the first longitudinal force is greater than the second longitudinal force.

22. The setting assembly as in claim 21, wherein the piston stroke rate is faster than the shaft stroke rate.

23. The setting assembly as in claim 17, wherein the piston is attached to the housing with a shear assembly.

24. The setting assembly as in claim 17, wherein the housing of the stroke amplifier assembly is connected to the downhole force generator.

25. The setting assembly as in claim 17, wherein the piston is releasably coupled to the moveable shaft using a one-way slip assembly.

26. The setting assembly as in claim 17, wherein the piston stroke length is greater than the shaft stroke length.

27. A method for transmitting force to and setting a downhole tool positioned in a wellbore, the method comprising the steps of:

moving a piston a piston stroke length in response to hydrostatic pressure in the wellbore, thereby transmitting a first force to the downhole tool by movement of the piston;

partially setting the downhole tool in response to the first force;

moving a powered shaft a shaft stroke length using a downhole force generator including a power supply, thereby transmitting a second force to the downhole tool by movement of the shaft;

moving the piston and moving the shaft in the same direction;

moving the piston and shaft at different speeds;

permitting relative movement between the shaft and piston in only a first direction; and partially setting the tool in response to the second force.

* * * * *